US009097030B1

(12) United States Patent
Manterfield

(10) Patent No.: US 9,097,030 B1
(45) Date of Patent: Aug. 4, 2015

(54) DEVICES, METHODS, SYSTEMS AND KITS FOR REVERSIBLY CONVERTING A NON-DWELLING PORTION OF A STRUCTURE INTO A DWELLING PORTION OF A STRUCTURE

(76) Inventor: Susan Jennings Manterfield, Noblesville, IN (US)

( * ) Notice: Subject to any disclaimer, the term of this patent is extended or adjusted under 35 U.S.C. 154(b) by 693 days.

(21) Appl. No.: 12/655,163

(22) Filed: Dec. 23, 2009

(51) Int. Cl.

| | |
|---|---|
| ***E04H 1/02*** | (2006.01) |
| ***E04H 1/12*** | (2006.01) |
| *E04B 1/343* | (2006.01) |
| *E04B 1/348* | (2006.01) |

(52) U.S. Cl.
CPC ..... *E04H 1/125* (2013.01); *E04B 1/34336* (2013.01); *E04B 1/34869* (2013.01); *E04H 1/02* (2013.01)

(58) Field of Classification Search
CPC ..... E04B 1/34336; E04B 1/34315; E04B 2001/34389; E04H 1/02; E04H 1/125
USPC ..... 52/79.5, 79.7, 79.8, 79.1–79.14, 23, 52/102, 561–563, 566, 569, 571, 575, 52/585.1
See application file for complete search history.

(56) References Cited

U.S. PATENT DOCUMENTS

| | | | | |
|---|---|---|---|---|
| 2,644,203 | A * | 7/1953 | Donahue | 52/34 |
| 3,585,767 | A * | 6/1971 | Wilk et al. | 52/79.1 |
| 4,221,441 | A * | 9/1980 | Bain | 312/228 |
| 4,327,529 | A * | 5/1982 | Bigelow et al. | 52/34 |
| 4,499,696 | A | 2/1985 | Freeauf | |
| 4,655,011 | A * | 4/1987 | Borges | 52/79.1 |
| 4,778,802 | A * | 10/1988 | Archibald et al. | 514/314 |
| 4,788,802 | A * | 12/1988 | Wokas | 52/79.1 |
| 5,265,384 | A | 11/1993 | Menke et al. | |
| 5,375,380 | A * | 12/1994 | Jones | 52/34 |
| 5,447,000 | A * | 9/1995 | Larsen | 52/79.1 |
| 5,459,966 | A * | 10/1995 | Suarez et al. | 52/34 |
| 5,638,646 | A * | 6/1997 | Shane | 52/79.1 |
| 5,724,773 | A * | 3/1998 | Hall | 52/34 |
| 6,067,771 | A | 5/2000 | Blankenship | |
| 6,438,903 | B1 * | 8/2002 | Weiss | 52/79.1 |
| 7,181,887 | B1 * | 2/2007 | Baij | 52/105 |
| 2003/0140572 | A1 * | 7/2003 | Hertzog et al. | 52/79.1 |
| 2003/0159366 | A1 * | 8/2003 | Christensen | 52/79.1 |
| 2007/0261318 | A1 * | 11/2007 | Mifsud et al. | 52/79.1 |
| 2008/0005976 | A1 * | 1/2008 | Montaigne | 52/79.1 |

* cited by examiner

*Primary Examiner* — Elizabeth A Plummer
*Assistant Examiner* — Kyle Walraed-Sullivan
(74) *Attorney, Agent, or Firm* — Taft Stettinius & Hollister LLP

(57) ABSTRACT

A separate living unit apparatus and kit configured to be positioned within a pre-existing structure including a structural frame supporting a set of side walls, an exterior wall, a set of interior walls, a ceiling and a floor; where the side walls include pre-finished drywall and insulation; where the ceiling includes pre-textured drywall and insulation; and where the floor has a subfloor of treated lumber with insulation and a floor covering including a carpet portion and a hard surface portion; an exterior door where the door is constructed within the exterior wall which separates the living unit from an exterior area; and where the interior walls define separate areas of the living unit, the separate areas including a living area, a bathroom and a kitchen.

20 Claims, 7 Drawing Sheets

DEVICES, METHODS, SYSTEMS AND KITS FOR REVERSIBLY CONVERTING A NON-DWELLING PORTION OF A STRUCTURE INTO A DWELLING PORTION OF A STRUCTURE

BACKGROUND

The present application generally relates to devices, methods, systems and kits for reversibly converting a non-dwelling portion of a pre-existing structure into a dwelling portion of a pre-existing structure by assembling a living unit within a pre-existing non-dwelling structure.

A wide variety of circumstances can lead to the need for additional living space to be provided within a pre-existing dwelling structure. For example, such needs can arise from a circumstance in which a family member has a need for oversight care but has limited financial means such as an adult child with special needs or is handicapped. In other instances, a friend or family member may require a significant amount of care or oversight or frequent visits, for example, due to an illness, injury, or the effects of aging; however, a degree of independence is desired or needed.

While the construction of an additional living unit within a garage of a pre-existing dwelling structure has been proposed, the solutions described previously have all suffered from a variety of drawbacks, limitations, disadvantages and problems including those respecting quality, efficiency, integrity, cost effectiveness and others. There is a need for further developments in this arena, and the present application provides methods, systems, devices and kits that address this need.

SUMMARY

In one aspect, the present application provides an apparatus for reversibly converting a non-dwelling portion of a structure into a dwelling portion of the structure. In one embodiment, the apparatus includes a separate living unit configured to be assembled within a pre-existing structure. The separate living unit includes a structural frame to support walls and a ceiling and provide a floor space. The structural frame can be assembled using common construction materials to afford a comfortable living space. Such common construction materials include structural members, such as for example, boards or planks made of wood, steel or other material, decking (also referred to herein as "deck sheeting"), finished drywall, insulation, floor covering, wiring, plumbing materials, and bathroom and kitchen fixtures.

In another embodiment, the apparatus includes a structural frame supporting a set of side walls, an exterior wall, a set of interior walls, a ceiling and a floor where the side walls include pre-finished drywall and insulation; the ceiling includes pre-textured drywall and insulation; and the floor includes a subfloor of treated lumber with insulation, floor decking over the treated lumber and a floor covering over the decking, the floor covering including a carpet portion and a hard surface portion; an exterior door mounted in the exterior wall to ingress and egress between the living unit and an exterior area; and where the interior walls define or demarcate separate areas of the living unit, the separate areas including a living area, a bathroom and a kitchen.

In another aspect, the present application provides a kit for assembling a separate living unit within a pre-existing structure. In one embodiment, the kit includes structural members to be assembled into a structural frame and materials for constructing walls, a ceiling and a floor. The kit can include materials designed for creating a pleasant and comfortable living unit such as insulation, wall paper, floor covering and bathroom and kitchen fixtures.

In another embodiment, the kit includes a plurality of linear structural members pre-cut to desired lengths and configured to be assembled in a predetermined arrangement into a structural frame for the living unit including an external wall, a set of side walls, a set of interior walls, a ceiling and a floor; a quantity of insulation material sufficient to insulate the exterior wall, the side walls, the floor and the ceiling; a plurality of pieces of pre-finished drywall having a size and number sufficient to cover exposed interior surfaces of the side walls and exposed surfaces of the interior walls; a plurality of pieces of pre-textured drywall having a size and number sufficient to cover an exposed interior surface of the ceiling; a plurality of pieces of deck sheeting for attachment to the floor of the structural frame and having a size and number sufficient to generally cover the floor, thereby providing a subfloor for the living unit; a plurality of pieces of exterior siding having a size and number sufficient to cover an exposed exterior surface of the exterior wall; a plurality of fixation devices for affixing the linear structural members, the deck sheeting, the pre-finished drywall, the pre-textured drywall and the exterior siding to one another during assembly of the living unit; a plurality of plumbing and electrical wiring materials; a set of bathroom fixtures for installation in a bathroom; a set of kitchen fixtures for installation in a kitchen; a heating/cooling unit for installation adjacent to a living area; a floor covering having dimensions sufficient to cover an exposed interior surface of the floor; an exterior door for installation in the exterior wall; at least one exterior window for installation in exterior wall; and instructions for assembling the linear structural members, the pre-finished drywall, the pre-textured drywall, the exterior siding and the deck sheeting, and for installing the insulation material, the bathroom fixtures, the kitchen fixtures, the heating/cooling unit, the utility connections, the exterior door, the exterior window and the floor covering.

Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
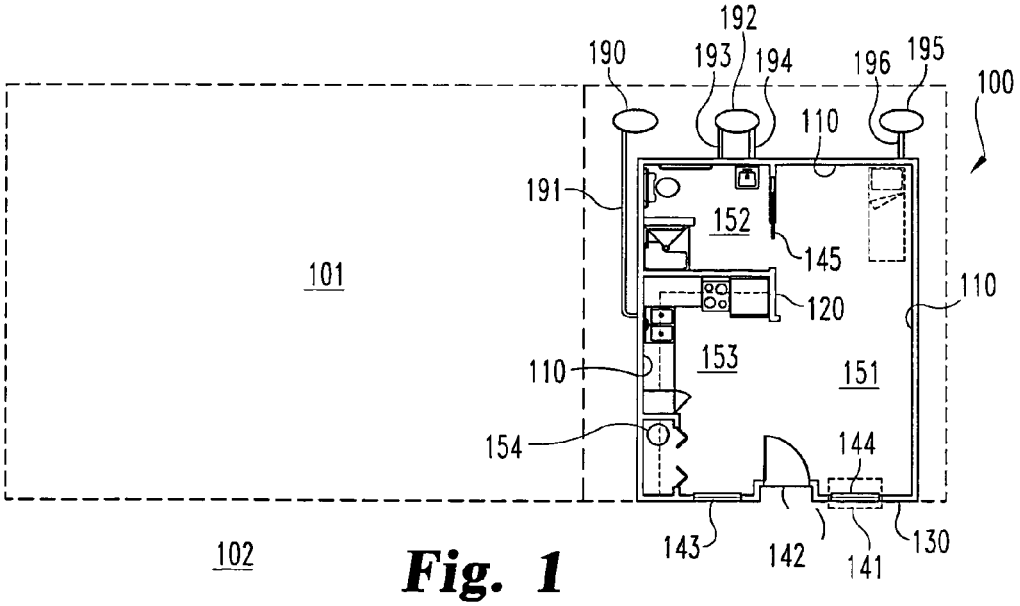
FIG. 1 is a top plan view showing a layout of a separate living unit embodiment within a pre-existing structure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

One embodiment of the present application is a separate living unit having a floor plan depicted in FIG. 1, which shows the relation between pre-existing structure 101 and separate living unit 100. Pre-existing structure 101 is contemplated to be a pre-existing home with an attached garage. It is also contemplated that a detached garage may be suitable as a pre-existing structure. It is further contemplated that living unit 100 can be constructed in any pre-existing space that has utility systems, i.e., electrical and plumbing systems, that can be accessed and connected to utility subsystems in living unit 100.

With reference to the embodiment depicted in FIG. 1, the electrical system of pre-existing structure 101 is schematically represented and identified as electrical system 190. The plumbing system of pre-existing structures 101 is schematically represented and identified as plumbing system 192. Electrical system 190 can have a wide variety of forms as would be appreciated by a person skilled in the art, including, for example, a breaker box (not shown), which is connected to an external source of electrical power, and which is also connected to internal wiring components. Plumbing system 192 can also have a wide variety of forms as would be appreciated by a person skilled in the art, including, for example, an external source of water, an external waste disposal system, and internal plumbing components. The external source of water can be, for example, a well or a municipal water supply system. The external waste disposal system can be for example, an individual septic system, such as, for example, a system commonly referred to as a mound system or a finger system, or a municipal septic system.

The electrical subsystem of living unit 100 is schematically shown in FIG. 1 to be connected to electrical system 190 by electrical connection 191. The plumbing subsystem of living unit 100 is schematically shown to be connected to plumbing system 192 by water source connection 193 and waste drain connection 194. The electrical subsystem of living unit 100 can include conventional electrical components such as, for example, a plurality of fixtures including, but not limited to lighting, kitchen appliances, HVAC unit and the like, and electrical outlets, together with the wiring for same. The plumbing subsystem of living unit 100 can include conventional plumbing components, such as, for example, a plurality of fixtures including, but not limited to bathroom sinks, drains, baths, showers, commodes and the like, kitchen sinks, drains and the like, and accessories thereto, including, for example, water heaters 154, water softeners, filters, pumps and the like, together with pipes, joints, conduits, brackets and sealants for same.

As another optional feature, the television reception system of pre-existing structure 101 can be connected to a television subsystem in living unit 100. The television reception system of pre-existing structure 101 is schematically represented in FIG. 1 and identified as television reception system 195. Television reception system 195 can have a wide variety of forms as would be appreciated by a person skilled in the art, including, for example, an antenna system, a cable system, a satellite system or a wireless internet system. The television reception subsystem of living unit 100 is schematically shown in FIG. 1 to be connected to television reception system 195 by television connection 196. The television reception subsystem of living unit 100 can include conventional television signal components, such as, for example, cables, receivers and the like.

In one embodiment, all utility systems are routed though a single hole in the banboard between a pre-existing home and a garage to a portion of the separate living unit proximate a toilet. All plumbing is routed to the toilet from the sinks, water heater and shower. In this embodiment, the electrical system utilizes the same access portions as the plumbing and not through a separate connection as depicted in the figure. The routing of the utilities may be modified to accommodate the specific plumbing and electrical systems of the pre-existing home and garage as would be understood by one skilled in the art.

Living unit 100 is constructed with side walls 110, interior walls 120 and at least one exterior wall 130. Side walls 110 separate living unit 100 from pre-existing structure 101. Interior walls 120 separate individual spaces within living unit 100. Interior walls are capable of including interior doors, such as, for example, door 145. Living area 151, bathroom 152 and kitchen 153 are considered individual spaces of living unit 100. Exterior wall 130 separates the interior of living unit 100 from exterior area 102 which is exterior to both living unit 100 and pre-existing structure 101. Exterior wall 130 includes exterior door 142 and exterior windows 143 and 144. In alternate embodiments, a living unit as described herein can include more than one external door and/or more than one exterior window. In addition, exterior doors and windows can have a wide variety of shapes, sizes and other features, as would occur to a person skilled in the art. Adjacent to exterior window 144 is HVAC unit 141 for maintaining a comfortable climate within living unit 100.

Figure 2:
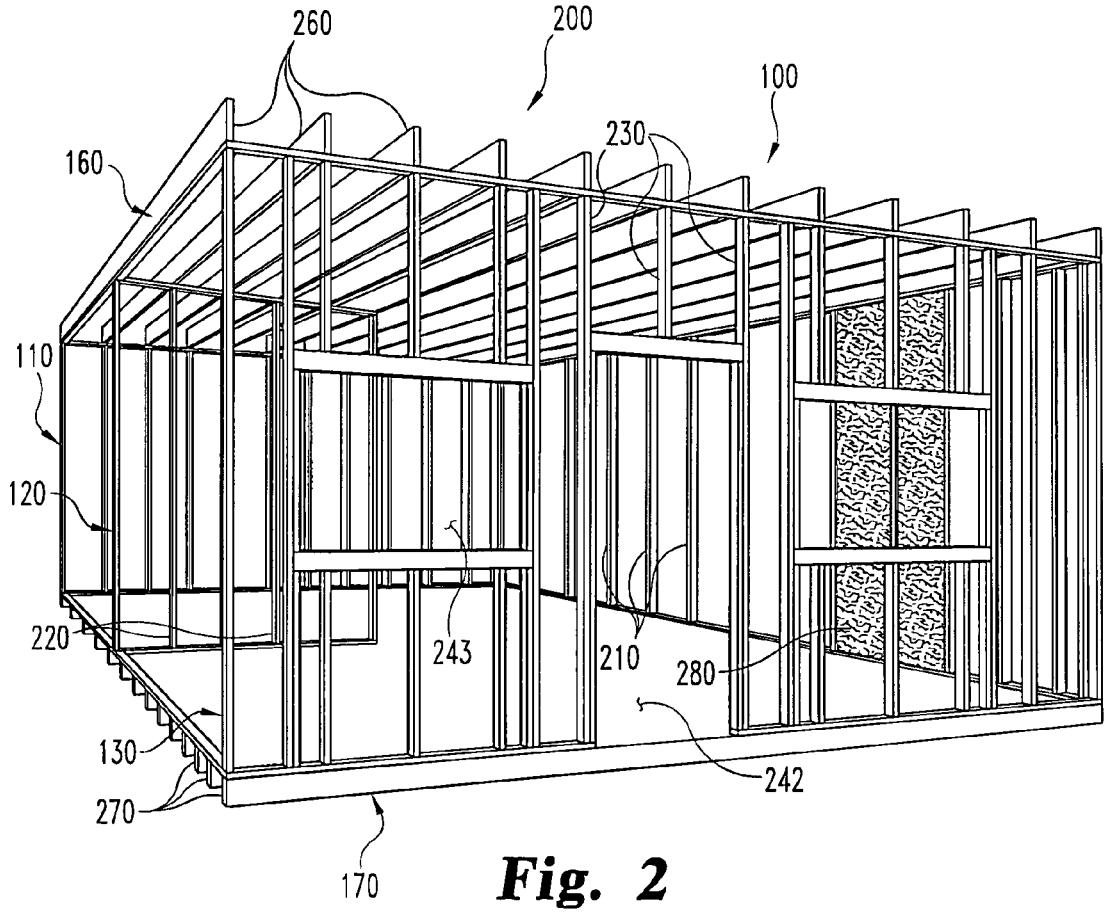
FIG. 2 is a perspective view of the structural frame of the separate living unit embodiment depicted in FIG. 1.

In reference to FIG. 2, structural frame 200 of living unit 100 is depicted. Structural frame 200 includes linear structural members 210 providing structural support to side walls 110, linear structural members 220 providing structural support to interior walls 120, linear structural members 230 providing structural support to exterior wall 130, linear structural members 260 providing structural support to ceiling 160 and linear structural members 270 providing structural support to floor 170. Linear structural members 210, 220, 230, 260 and 270 can be, for example, dimensional lumber, steel C-channels or other construction materials known to those skilled in the art. Insulation 280 is positioned between linear structural members 210 of side wall 110, and is also contemplated as being present between linear structural members 220 of interior walls 120, between linear structural members 230 of exterior wall 130, between linear structural members 260 of ceiling 160 and/or between linear structural members 270 of floor 170. Exterior wall 130 defines openings 242, 243 for exterior door (not shown) and exterior windows (not shown), respectively.

Figure 3:
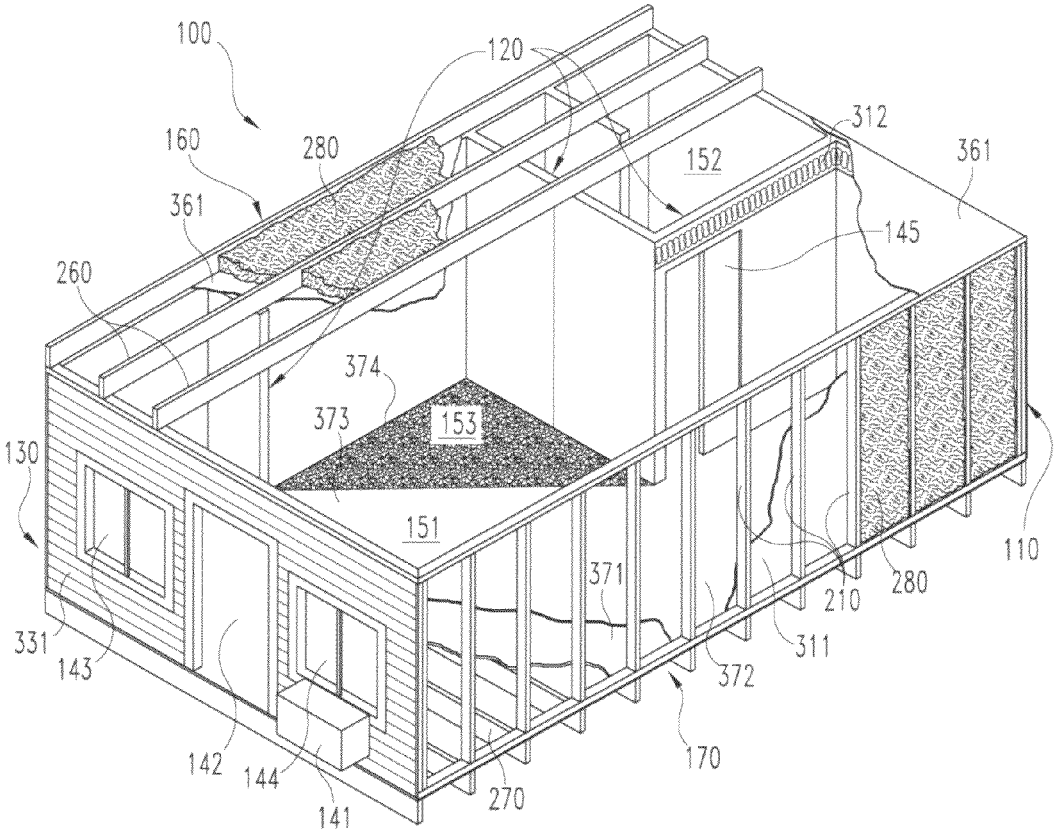
FIG. 3 is a partial cut-away perspective view of the separate living unit embodiment depicted in FIG. 1.

Additional details of living unit 100 are shown in FIG. 3. Side walls 110 are shown constructed of a plurality of linear structural members 210. Insulation 280 is placed between linear structural members 210 and pre-finished drywall 311 is applied on the exposed interior surfaces of side walls 110. Insulation can also be placed between linear structural members (not shown) and pre-finished drywall 311 is placed on exposed interior surface of interior walls 120. The exposed surfaces are those portions of the various structures visible to an occupant (i.e., that are not covered by cabinets, fixtures or the like). Other forms of drywall such as wallboard, gypsum board, plasterboard, cement board and building board are contemplated. In one embodiment pre-finished drywall 311 includes vinyl-covered drywall.

Some portions of sidewall 110 and interior wall 120 include decorative wall covering 312. Decorative wall covering 312 is placed on pre-finished drywall 311 adjacent to ceiling 160. Decorative wall covering 312 is capable of being placed in a location so as to cover any unevenness in the seam between sidewall 110, interior wall 120 or exterior wall 130 and ceiling 160.

Ceiling 160 includes linear structural members 260 supported at their respective ends by exterior wall 130 and sidewall 110 that is positioned opposite exterior wall 130. In the embodiment shown in FIG. 3, linear structural members 260 of ceiling 160 are shown in a front-to-back orientation, i.e., with their ends supported by exterior wall 130 and opposite sidewall 110; however, it is understood that in alternative embodiments, linear structural members 260 of ceiling 160 can be placed in a side-to-side orientation, i.e., with their ends supported by two side walls 110. Insulation 280 is positioned between linear structural members 260 of ceiling 160. Pre-textured drywall 361 is applied to the exposed interior surfaces of ceiling 160. In alternative embodiments, insulation 280 can be absent, or can be positioned over only one or more portions of living unit 100, and pre-textured drywall 361 can be replaced by other types of material as would occur to a person of ordinary skill in the art.

Interior walls 120 are shown separating bathroom 152 from living area 151 and kitchen 153. Interior walls 120 include linear structural members 220 (not shown) and pre-finished drywall 311. Insulation 280 (not shown) is capable of being placed between linear structural members 220 (not shown) of interior wall 120. Insulation 280 is contemplated to serve climate control functions as well as noise and vibration dampening functions. Interior door 145 is shown as a pocket door in interior wall 120. It is also contemplated that interior door 145 can be a traditional hinged door, an accordion door, a sliding door, or any other design for occupying a doorway. In other embodiments, interior door 145 is omitted.

Exterior wall 130 is shown with exterior siding 331 covering the exposed exterior surface of exterior wall 130. Not shown is the interior construction of exterior wall 130. It is contemplated that the interior construction of exterior wall 130 be similar to that of side wall 110 with linear structural member 230 (not shown), insulation 280 (not shown) and pre-finished drywall 311 (not shown). Mounted to exterior wall 130 are exterior door 142, exterior windows 143, 144 and HVAC unit 141. The embodiment depicted in FIG. 3 includes two exterior windows 143,144—one on each side of exterior door 142; however, embodiments with more or fewer windows and/or with windows placed in other positions are also contemplated.

Floor 170 of living unit 100 includes linear structure members 270. In one embodiment linear structure members 270 of floor 170 comprise treated dimensional lumber. Other construction materials known to those familiar with the art are also contemplated. Above linear structural member 270 of floor 170 is deck sheeting 371. Deck sheeting 371 may comprise plywood, composite sheeting, OSB, parallel strand board or pressed wood such as engineered wood, fiber board or particle board.

Floor covering 372 is applied over deck sheeting 371. Floor covering 372 can be for aesthetic or functional purposes. In the embodiment shown in FIG. 3, floor covering 372 includes two types such as carpet 373 in living area 151 and hard floor 374 in bathroom 152 (not shown) and kitchen 153. Carpet 373 may be of any type of carpet known in the floor covering industry. Hard floor 374 can be, but is not limited to, vinyl, wood, laminate, ceramic, tile or other material known to those skilled in the art. In other embodiments, floor covering 372 is of a single type, either carpet or hard floor throughout living unit 100. In still others, several types of floor covering 372 can be used in different areas of living unit 100. Preparations and additional materials for the floor covering such as padding and vapor barriers as are known or understood in the art may also be included.

Figure 4:
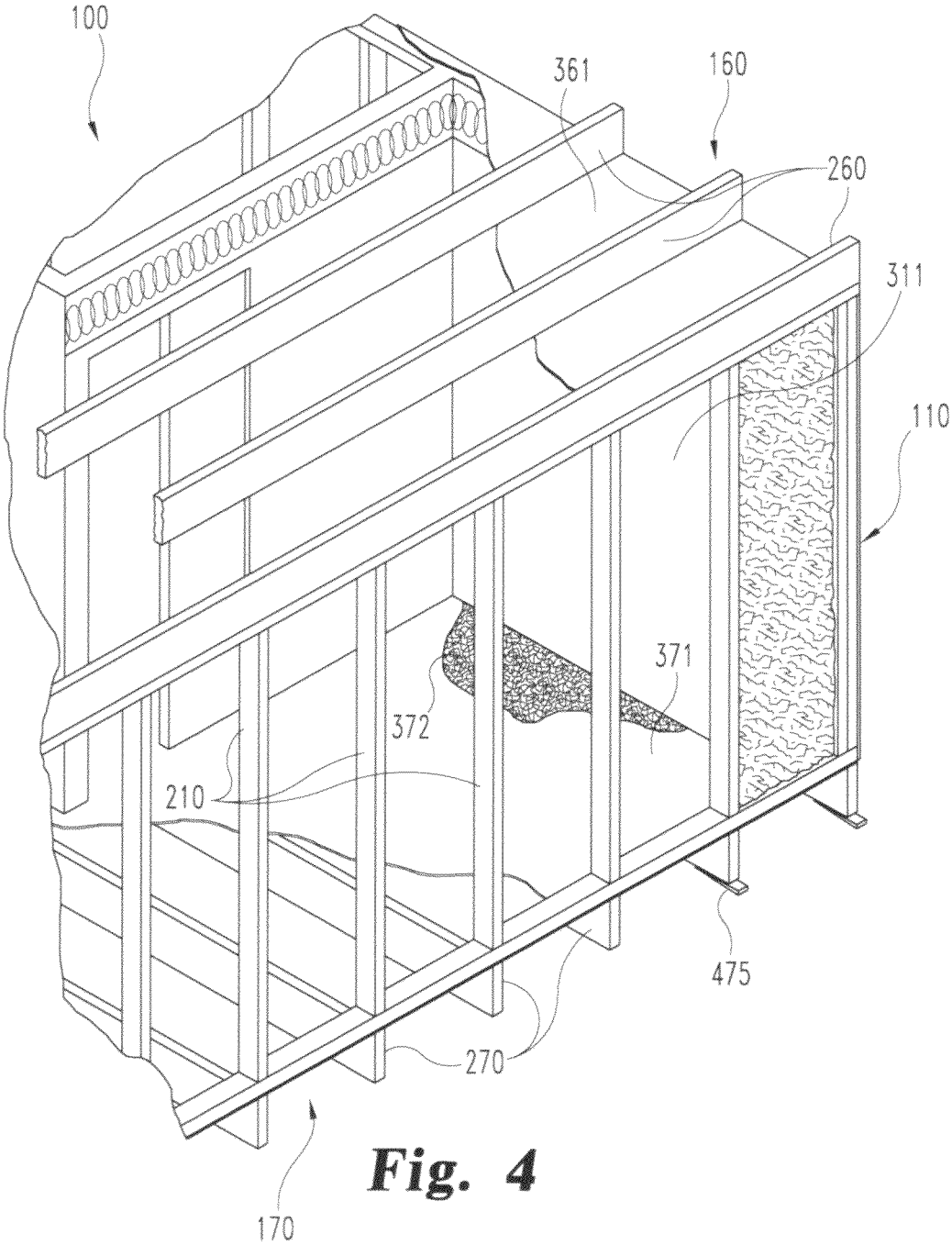
FIG. 4 is a partial cut-away perspective view of the walls and floor of the separate living unit embodiment depicted in FIG. 1.

FIG. 4 shows a partial view of living unit 100 with linear structural members 210 for sidewalls 110, linear structural members 260 for ceiling 160 and linear structural members 270 for floor 170. Pre-finished drywall 311 is shown on the exposed interior surface of side wall 110. Pre-textured drywall 361 is shown on the exposed interior surface of ceiling 160. Floor 170 is shown with deck sheeting 371 and floor covering 372. Shim 475 is shown under linear structural member 270 as one option for leveling floor 170 on an unlevel floor of the pre-existing structure (not shown).

Figure 5:
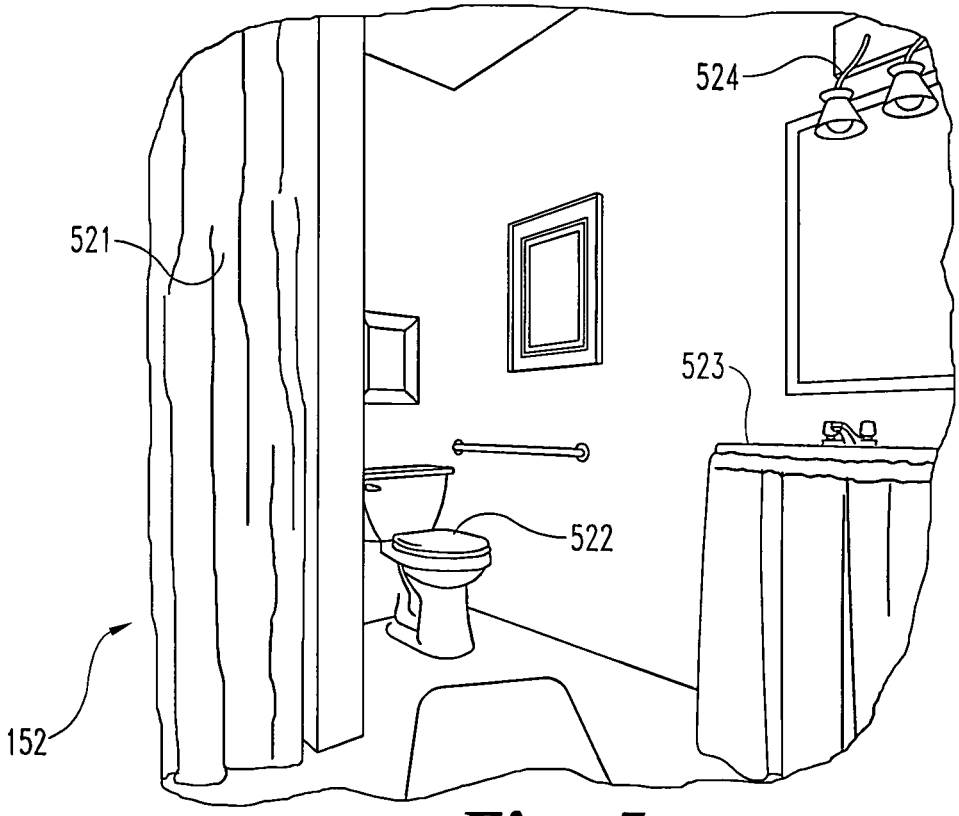
FIG. 5 is a perspective view of a bathroom in the separate living unit embodiment depicted in FIG. 1.
Figure 6:
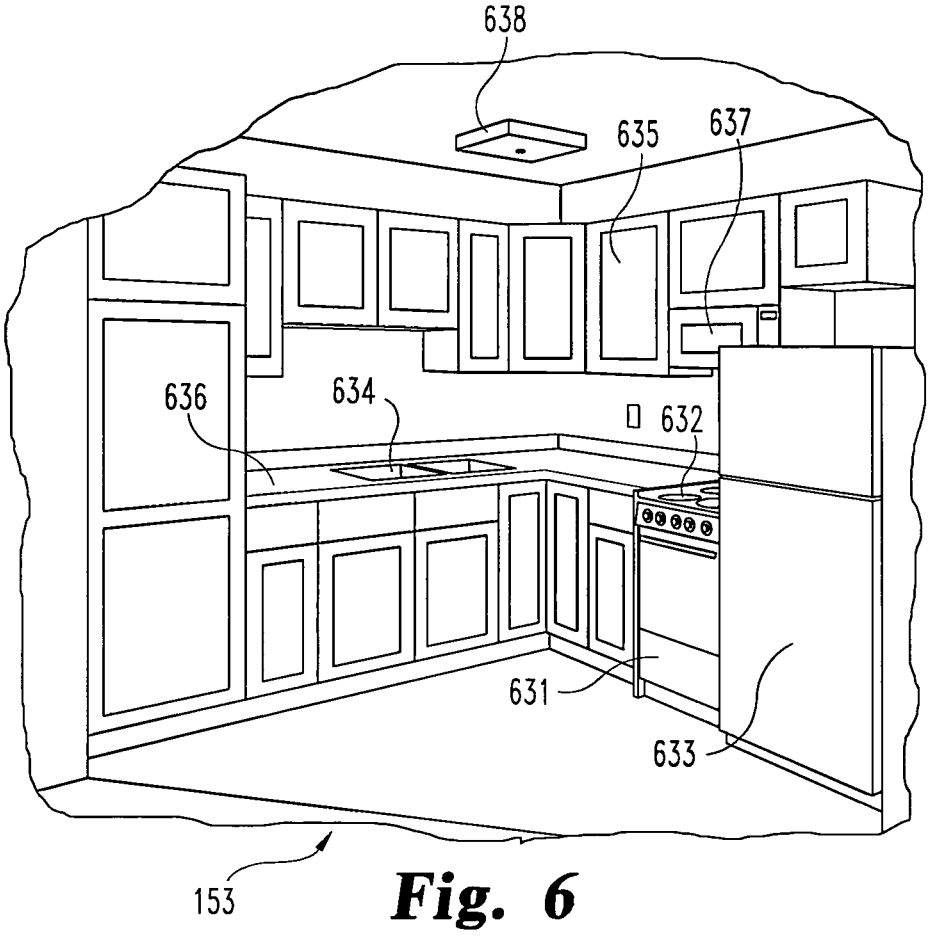
FIG. 6 is a perspective view of a kitchen in the separate living unit embodiment depicted in FIG. 1.

FIG. 5 shows bathroom 152. Bathroom 152 includes shower 521, toilet 522, sink 523 and lighting 524. The bathroom may also include accessibility fixtures such as a roll in shower, a roll under sink and bathroom safety grab bars in various locations. FIG. 6 is a perspective view of kitchen 153. Kitchen 153 includes oven 631, range 632, refrigerator 633, sink 634, cabinets 635, counters 636, microwave 637 and lighting 638. It is also contemplated that components can be added or removed similar to kitchen and bath designs known to those skilled in the art.

Figure 7:
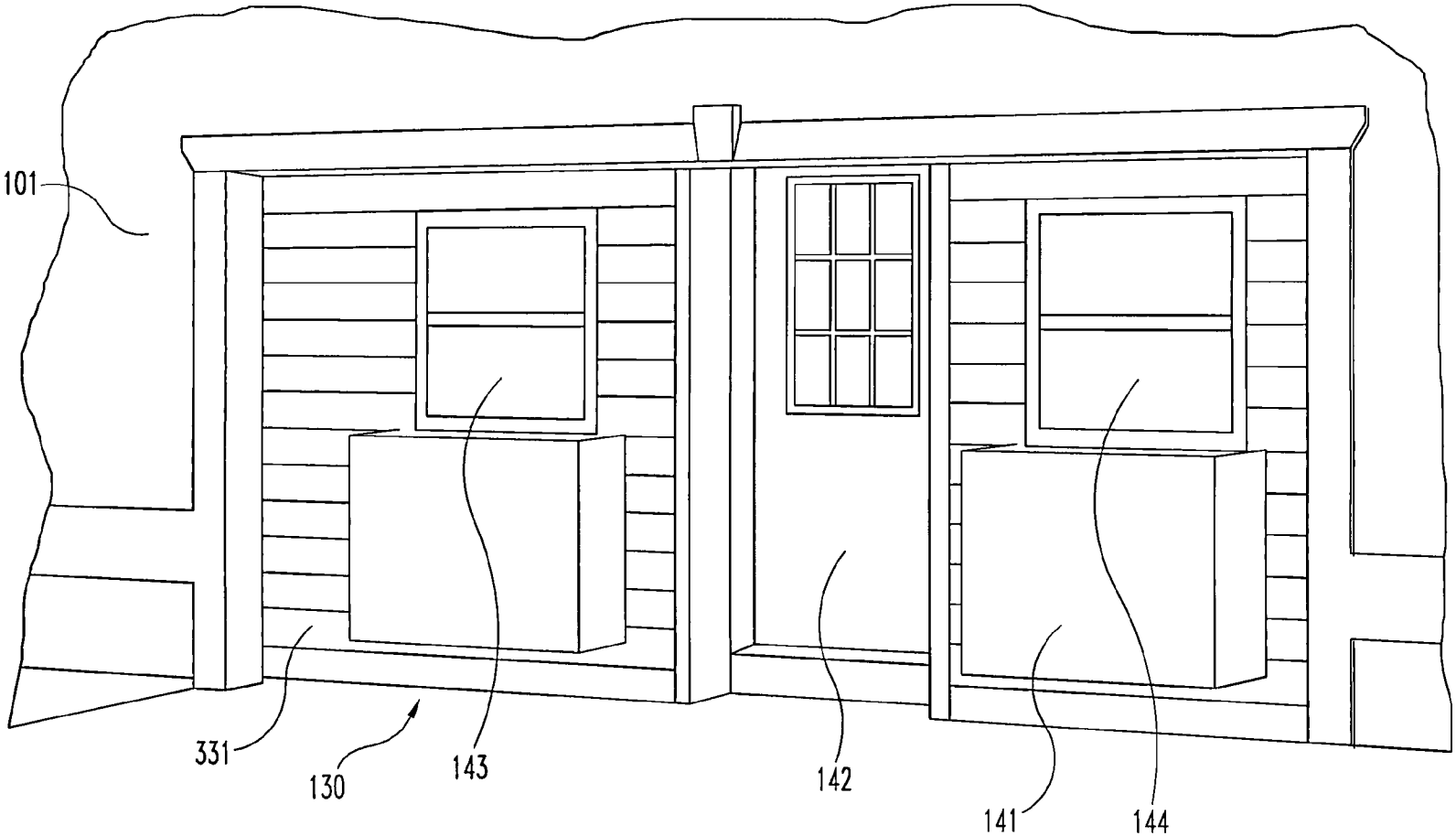
FIG. 7 is a front view of an exterior wall of the separate living unit embodiment depicted in FIG. 1 in the context of a pre-existing structure.

In FIG. 7, exterior wall 130 includes exterior windows 143,144 exterior door 142 and HVAC unit 141. Exterior siding 331 covers exposed exterior surface of exterior wall 130. Exterior siding 331 is constructed with building materials suitable for outside exposures such as, but not limited to, stucco, stone veneer, cement fiber, wood, cedar shingles, engineered or composite materials, brick, vinyl, aluminum or other materials known by those skilled in the art. It is contemplated that exterior siding 331 be chosen to compliment the exterior of pre-existing structure 101.

Exterior door 142 is constructed of materials suitable for exterior applications such as, but not limited to, steel, aluminum or vinyl-clad, wood, fiberglass or other materials known to those skilled in the art. Exterior door 142 is contemplated to be any design known to those skilled in the art such as, but not limited to, a single door with or without windows, with or without blinds, or with or without stained or leaded glass. Exterior windows 143,144 are contemplated to be constructed of materials commonly known to those skilled in the art and of a design such as, but not limited to, double- or single-hung sash, casement, awning, bay, fixed or horizontal sliding sash windows.

Living unit 100 described above is configured for placement in a pre-existing structure having a single garage door opening sized for a two-car garage. For example, typical garage door openings of this type have the following dimensions: 8'×18'. In this embodiment, exterior wall 130 includes exterior door 142 and two exterior windows 143,144 with HVAC unit 141 below one of the two exterior windows 143, 144 as depicted in FIGS. 1-3 and 7. In another embodiment (not shown), a living unit is configured for placement in a pre-existing structure having a two-car garage with two separate single car garage door openings. In this embodiment, the living unit has two exterior walls, and features an exterior door in one exterior wall and a single exterior window in the other exterior wall, with an HVAC unit positioned below the one exterior window.

Due to standardization in the residential garage door industry, a majority of pre-existing residences have garage door openings selected from a relatively few dimensions. Thus, the separate living units contemplated by the present application lend themselves well to standardization. Thus, the present application contemplates a system in which detailed plans for a number of predesigned living units are provided, each plan corresponding to a living unit adapted for assembly in a garage having a specific garage door opening arrangement. For example, one representative plan corresponds to a living unit adapted for assembly in a garage having a single garage door opening having the dimensions 8'×18'; another representative plan corresponds to a living unit adapted for assembly in a garage having two garage doors having the dimensions 8'×7' and separated by 2'. As a person skilled in the art will appreciate, in this way, a set of detailed plans are assembled, and when a customer or potential customer makes an inquiry, an appropriate plan can be readily identified based upon the dimensions of the garage door opening or openings in existence at that location. Moreover, given the relatively small number of garage door opening arrangements, a materials list can be readily generated for each plan, and materials kits can be provided, as discussed further below, thus providing a standardized and efficient process for installing a separate living unit in a pre-existing residence.

For example, when a customer decides to install a separate living unit, a predesigned detailed plan is selected based upon the dimensions of garage door openings in the pre-existing residence. The detailed plan is associated with a materials list and a set of assembly instructions for the installer. While some components of the material list can be variable, such as, for example, the type and color of floor coverings, the majority of the materials list is standardized based on the dimensions of the garage door openings. Once the materials list is finalized, material ordering and delivery can be initiated.

With regard to site preparation, it is understood that it may be necessary to obtain approval for any change to the pre-existing structure from one or more controlling realty association and/or local government entities before assembly of the living unit can be initiated. Once the necessary approvals are obtained and materials delivered, the only other site preparation required before assembly of the structural frame may begin is the clearance of the space where the separate living unit is to be assembled and removal of the existing garage doors (if any) and related equipment.

After the structural frame of the living unit has been assembled, the floor of the structural frame is made level by placing shims under the linear structural members of the floor as necessary to compensate for any unevenness in the floor of the pre-existing structure. The structural frame and other components of the living unit are assembled in accordance with provided instructions and generally as described above in connection with living unit 100.

Once the plumbing and electrical subsystems, and optionally a television reception subsystem, for the separate living unit are assembled, these subsystems are connected to the electrical and plumbing systems of the pre-existing structure. Typically, the plumbing system of the pre-existing structure can be accessed through a basement or crawlspace of the pre-existing structure, if present, and the electrical system of the pre-existing structure can be accessed at a fuse box.

For embodiments that include pre-finished and pre-textured drywall, no further wall covering application is needed. This saves the time and labor costs of more traditional wall covering techniques such as painting or wallpapering. However, if painting or wallpapering is desired, these can be accommodated.

As stated above, the devices and methods described in the present application lend themselves well to the development of a system for assembling uniform living spaces with equivalent proportions and features, and allow for the implementation of a system where a pre-made materials list can be readily filled by a building supply store in virtually any location, with limited notice, and delivered to the pre-existing structure. The present application also contemplates a kit that includes the materials identified in the materials list and instructions for assembling and installing same. With the arrival of the kit at an installation site, a certified builder is able to follow the instructions to quickly and efficiently assemble a separate living unit.

This process allows for quick delivery of a finished product with fixed and therefore known costs to the customer. While customization is often desired in a living environment, adhering to the specified materials list of the kit and design of the apparatus of the present invention allows for quick delivery and controlled costs. Customization can be realized in the personal furnishings of the separate living unit applied after the completion of the construction.

In view of the above, another aspect of the present application is a kit for assembling a separate living unit within a pre-existing structure which includes a set of building materials necessary for construction of the separate living unit and instructions for construction and assembly of each component of the living unit. In another embodiment, the instructions included in the kit provide direction for assembling the linear structural members, the pre-finished drywall; the pre-textured drywall, the exterior siding and the deck sheeting, and for installing the insulation material, the bathroom fixtures, the kitchen fixtures, the water heater, the heating/cooling unit, the utility connections, the exterior door, the interior door, the exterior window and the floor covering. The kit can be delivered to the construction site or picked up at a building materials supplier facility. A building crew is able to obtain the kit and complete construction within a two-week period for a fixed cost.

The living unit kit includes linear structural members pre-cut to desired lengths and configured to be assembled in a predetermined arrangement into a structural frame for the living unit. In one embodiment, the linear structural members are labeled for identification of the order and position in which the members are to be assembled therefore speeding the construction process. In this embodiment, each linear structural member, or each set of generally equivalently dimensioned linear structural members, bears indicia to indicate a desired placement for the linear structural members in the structural frame.

An insulation material is included in the kit in sufficient amount to insulate the exterior wall, the side walls, the floor and the ceiling. In addition, a sufficient amount of pre-finished drywall sized and numbered to cover the exposed interior surfaces of the side wall and the exposed surfaces of the interior wall is included in the kit. Also, pre-textured drywall sized and numbered sufficient to cover an interior surface of the ceiling is included in the kit. Deck sheeting to be attached to the floor of the structural frame is included in the kit in sufficient size and number to generally cover the floor, thereby providing a subfloor for the living unit. Exterior siding sized and numbered sufficient to cover exposed exterior surfaces of the exterior wall is included in the kit. Also included in the kit is a set of bathroom fixtures for installation in the bathroom, a set of kitchen fixtures for installation in the kitchen, and a heating/cooling unit for installation adjacent to the living area.

A floor covering having dimensions sufficient to cover the exposed interior surfaces of the floor is also included in the kit. In one embodiment, the floor covering includes a member selected from the group consisting of carpet, vinyl flooring, ceramic tile, laminate flooring and combinations thereof. In another embodiment, the floor covering includes a carpet portion and a hard surface portion. In one embodiment, the hard surface portion is positioned in the bathroom and the kitchen and the carpet portion is positioned in the living area.

An exterior door and at least one exterior window are also included in the kit to be installed in the exterior wall. In one embodiment, at least one interior door is also included to be installed in one or more of the interior walls. Plumbing fixtures and electrical wiring sufficient to make utility connections between the separate living unit and the primary dwelling are also included in the kit.

The kit also includes fixation devices for affixing the linear structural members, the pre-finished drywall, the pre-textured drywall and the deck sheeting to one another during assembly of the living unit. In one aspect, the fixation devices comprise one or more members selected from the group consisting of nails, screws and adhesive.

In another embodiment, a decorative wall covering can be included in the kit. For example, a decorative wall covering can be included that is configured to be placed on the interior exposed surfaces of the side walls and the interior walls adjacent to the ceiling. In this embodiment, the instructions further include instructions for installing the decorative wall covering.

The kit also includes a set of bathroom fixtures including, for example and without limitation, a shower, a toilet, a sink, accessibility fixtures and a bathroom lighting fixture, and a set of kitchen fixtures including, for example and without limitation, an oven, a range, a refrigerator, a double sink, a set of cabinets, a countertop, a microwave, and a kitchen lighting fixture. The kit further includes a water heater and the instructions further include instructions for installing the water heater. The kit also includes exterior siding including, for example and without limitation, a material selected from the group consisting of stucco, stone veneer, cement fiber, wood, cedar shingle, engineered wood, brick, vinyl, aluminum and combinations thereof.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A kit for assembling a separate living unit within the garage of a pre-existing dwelling comprising:

a plurality of linear structural members pre-cut to desired lengths and including indicia indicating a desired placement of said linear structural members in a predetermined arrangement into a structural frame for the separate living unit, such that upon assembly of said linear structural members according to the desired placement said structural frame includes an external wall, a set of side walls, a set of interior walls, a ceiling and a floor;

said structural frame sized and configured to be positioned within the garage of the pre-existing dwelling such that said exterior wall includes a door communicating between an internal space of said living unit and an exterior space of said dwelling and said side walls are formed without any doors, and further such that said exterior wall forms a boundary separating the internal space from said exterior area of the preexisting structure;

said structural frame further being sized and configured such that a space extends between said side walls and three walls of said garage for positioning of utility subsystems for said separate living unit that communicate with said interior space via at least one of said side walls;

said set of interior walls sized and configured to separate the separate living unit into a plurality of sections including a living area, a bathroom, and a kitchen;

an insulation material to insulate said exterior wall, said side walls, said floor and said ceiling;

a plurality of pieces of pre-finished drywall to cover a set of exposed interior surfaces of said side walls and a set of exposed surfaces of said interior walls;

a plurality of pieces of pre-textured drywall to cover an exposed interior surface of said ceiling;

a plurality of pieces of deck sheeting for attachment to said floor of said structural frame and to generally cover said floor, thereby providing a subfloor for the living unit;

a plurality of pieces of exterior siding to cover an exposed exterior surface of said exterior wall;

a set of bathroom fixtures for installation in the bathroom;

a set of kitchen fixtures for installation in the kitchen;

a heating/cooling unit for installation adjacent to said living area;

a floor covering to cover an exposed interior surface of said floor;

an exterior door for installation in said exterior wall;

at least one exterior window for installation in said exterior wall;

a plurality of plumbing and electrical wiring materials; and a plurality of fixation devices for affixing said linear structural members, said pre-finished drywall, said pre-textured drywall and said deck sheeting to one another during assembly of the living unit.

2. The kit of claim 1 wherein said fixation devices comprise one or more members selected from the group consisting of nails, screws and adhesive.

3. The kit of claim 1 wherein said linear structural members comprise dimensional lumber pieces or steel C-channels.

4. The kit of claim 1 further comprising shims for use in leveling said subfloor and wherein a first portion of said plurality of linear structural members are identified for use in assembling said floor, said first portion comprising treated lumber.

5. The kit of claim 1 wherein said floor covering comprises a member selected from the group consisting of carpet, vinyl flooring, ceramic tile, laminate flooring and combinations thereof.

6. The kit of claim 1 wherein said floor covering includes a carpet portion and a hard surface portion.

7. The kit of claim 1 further including a decorative wall covering configured to be placed on said side walls and said interior walls and adjacent to said ceiling.

8. The kit of claim 1 wherein said set of bathroom fixtures comprises a shower, a toilet, a sink and a bathroom lighting fixture.

9. The kit of claim 1 wherein said set of kitchen fixtures comprises an oven, a range, a refrigerator, a double sink, a set of cabinets, a countertop, a microwave, and a kitchen lighting fixture.

10. The kit of claim 1 further including a water heater.

11. The kit of claim 1 wherein said exterior siding comprises a member selected from the group consisting of stucco, stone veneer, cement fiber, wood, cedar shingles, engineered or composite materials, brick, vinyl, aluminum and combinations thereof.

12. The kit of claim 1 further including at least one interior door for installation in said interior walls.

13. A system including a separate living unit apparatus positioned within a preexisting structure, comprising:

a preexisting structure, said preexisting structure defining an interior area within the preexisting structure and an exterior area outside of the preexisting structure; and a separate living unit apparatus positioned within said preexisting structure, the separate living apparatus comprising:

a structural frame supporting a set of side walls, an exterior wall, a set of interior walls, a ceiling and a floor; wherein said side walls include a pre-finished drywall and an insulation; wherein said ceiling includes a pre-textured drywall and an insulation; and wherein said floor having a subfloor of treated lumber with insulation and a deck sheeting and a floor covering including a carpet portion and a hard surface portion; and an exterior door constructed in said exterior wall;

wherein said set of side walls and said exterior wall define an internal space within said separate living unit;

wherein said exterior wall forms a boundary separating the internal space from said exterior area of the preexisting structure;

wherein said interior walls define individual areas of the living unit, said individual areas including a living area, a bathroom and a kitchen;

wherein said preexisting structure comprises a dwelling, said interior area comprises a garage of said dwelling, and said separate living unit apparatus is positioned within said garage;

wherein said structural frame includes linear structural members bearing indicia indicating a desired placement for said linear structural members in said structural frame, and said linear structural members are placed according to said indicia, such that each of said side walls is positioned at a location spaced from one of three walls of said garage so as to define a space extending between said separate living unit and said three walls;

wherein said exterior wall includes a door therein, and each of said side walls is formed without any door; and wherein utility subsystems for said separate living unit are positioned within said space, and are in communication with said interior space of said separate living unit by way of one or more of said side walls.

14. The system of claim 13 wherein said structural frame includes a dimensional lumber frame.

15. The system of claim 13 further including a decorative wall covering wherein said decorative wall covering is placed on said interior walls and on said side walls adjacent to said ceiling.

16. The system of claim 13 wherein said bathroom comprises a shower, a toilet, a sink and a bathroom lighting fixture.

17. The system of claim 13 wherein said kitchen comprises an oven, a range, a refrigerator, a double sink, a set of cabinets, a countertop, a microwave, and a kitchen lighting fixture.

18. The system of claim 13 further including a self-contained heating and air conditioning unit and a water heater.

19. The system of claim 13 wherein said exterior wall further includes at least one exterior window.

20. The kit of claim 6 wherein said hard surface portion is positioned in said bathroom and said kitchen, and wherein said carpet portion is positioned in said living area.

* * * * *